US008696383B2

(12) United States Patent
Do

(10) Patent No.: US 8,696,383 B2
(45) Date of Patent: Apr. 15, 2014

(54) CONNECTOR GROUND SHIELD MECHANICAL ATTACHMENT

(75) Inventor: Trent K. Do, Milpitas, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/610,731

(22) Filed: Sep. 11, 2012

(65) Prior Publication Data

US 2014/0069707 A1 Mar. 13, 2014

(51) Int. Cl.
*H01R 9/03* (2006.01)

(52) U.S. Cl.
USPC ..... 439/607.35; 439/607.55

(58) Field of Classification Search
USPC ..... 439/607.01, 607.35, 607.36, 607.4, 439/607.55, 607.56
See application file for complete search history.

(56) References Cited

U.S. PATENT DOCUMENTS

| | | | | |
|---|---|---|---|---|
| 8,202,123 | B1 * | 6/2012 | Lin et al. | 439/607.54 |
| 8,360,808 | B2 * | 1/2013 | Tsuchiya | 439/607.55 |
| 8,435,075 | B2 * | 5/2013 | Lim et al. | 439/607.35 |
| 8,444,439 | B2 * | 5/2013 | Cao et al. | 439/607.35 |
| 8,579,665 | B2 * | 11/2013 | Yu et al. | 439/668 |

* cited by examiner

*Primary Examiner* — Khiem Nguyen
(74) *Attorney, Agent, or Firm* — Kilpatrick Townsend & Stockton LLP

(57) ABSTRACT

Connector receptacles that can be easily and reliably assembled to form ground shields. One example provides an inner shell having one or more alignment features and an outer shell having one or more corresponding alignment features. The one or more alignment features on the inner shell may mate with the one or more alignment features on the outer shell. When the one or more alignment features on the inner shell mate with the one or more alignment features on the outer shell, the outer shell may be mechanically secured to the inner shell, the outer shell and the inner shell may be electrically connected, and the outer shell may be aligned to the inner shell. The alignment features may be protrusions such as dimples, openings or holes, or other features.

20 Claims, 7 Drawing Sheets

CONNECTOR GROUND SHIELD MECHANICAL ATTACHMENT

BACKGROUND

The numbers and types of electronic devices available to consumers have increased tremendously the past few years, and this increase shows no signs of abating. Devices such as portable computing devices; tablet, desktop, and all-in-one computers; cell, smart, and media phones; storage devices; portable media players; navigation systems; monitors and other devices have become ubiquitous.

These devices often receive and provide power and data using various cable assemblies. These cable assemblies may include connector inserts, or plugs, on one or more ends of a cable. The connector inserts may plug into connector receptacles on electronic devices, thereby forming one or more conductive paths for signals and power.

The connector receptacles may be formed of housings that typically at least partially surround and provide mechanical support for contacts. These contacts may be arranged to mate with corresponding contacts on the connector inserts or plugs to form portions of electrical paths between devices. The connector receptacles may further include features to help to provide an initial resistance to the insertion of a connector insert. Features to provide retention to prevent inadvertent removal of a connector insert may also be included.

These connector receptacles may further include ground shields. Ground shields may provide radio frequency (RF) shielding for the connector receptacles. This shielding may prevent signal switching noise at a connector receptacle from interfering with circuitry inside an electronic device housing the connector receptacle. The shielding may also protect signals in the connector receptacle from interference from with circuitry inside the electronic device housing the connector receptacle.

Shields for connector receptacles may be formed of multiple portions which may be referred to as shells. These shells are typically laser or spot-welded together during assembly. But this procedure may be complicated and may be subject to low assembly yields.

Thus, what is needed are shells for connector receptacles that can be easily and reliably assembled to form ground shields.

SUMMARY

Accordingly, embodiments of the present invention may provide shells for connector receptacles that can be easily and reliably assembled to form ground shields. An illustrative embodiment of the present invention may provide an inner shell having one or more alignment features and an outer shell having one or more corresponding alignment features. The one or more alignment features on the inner shell may mate with the one or more alignment features on the outer shell. When the one or more alignment features on the inner shell mate with the one or more alignment features on the outer shell, the outer shell may be mechanically secured to the inner shell. This type of mechanical attachment may allow two or more shells to be joined to form a shield without the use of soldering, or of spot or laser welding. This may, in turn, simplify assembly and improve the reliability and yield of the assembly process.

In various embodiments of the present invention, the alignment features may be protrusions such as dimples, openings or holes, depressions, slots, cantilevered or other types of beams, fingers, or other features. Again, these features may physically or mechanically connect two or more shells together. The features may also align two or more shells in place relative to each other. The alignment features may also provide an electrical connection between the two or more shells forming a shield. The alignment features may be placed one on each of two sides, one on each of more than two sides, more than one on two or more sides, or in other configurations.

Another illustrative embodiment of the present invention may provide a connector receptacle. The connector receptacle may include a housing having an opening to receive a connector insert, where a number of contacts are located in the opening. A shield may be formed of an inner shell and an outer shell. The inner shell may at least partially surround the housing. The inner shell may include one or more alignment features, for example, a first alignment feature on a first side and a second alignment feature on a second side. The outer shell may at least partially surround the inner shell. The outer shell may include one or more alignment features. For example, the outer shell may include a first alignment feature on a first side to mate with the first alignment feature on the inner shell and a second alignment feature on a second side to mate with the second alignment feature on the inner shell. When the first alignment feature on a first side mates with the first alignment feature on the inner shell and a second alignment feature on a second side mates with the second alignment feature on the inner shell, the outer shell may be mechanically and electrically attached to the inner shell, and the outer shell may be physically aligned with the inner shell.

Portions of connector receptacles according to embodiments of the present invention may be formed using various materials. For example, the housing may be formed of plastic, nylon, or other non-conductive material. The inner shell and outer shell may be formed using a conductive material, such as metal. They may be formed using stainless steel, copper, copper alloy, tin, brass, palladium nickel, or other material. They may be plated with gold, tin, or other material, for example, to increase durability, conductivity, or solderability. Contacts and other conductive portions may be similarly formed.

Another illustrative embodiment of the present invention may provide a method of assembling a connector receptacle. This method may include receiving a housing. The housing may have a front side opening to receive a connector insert. A front opening of an inner shell may be aligned to a back of the housing. The inner shell may include one or more alignment features, for example, the inner shell nay have a first alignment feature on a first side and a second alignment feature on a second side. The inner shield may be slid over the housing. A front opening of an outer shell may be aligned to a back of the housing and the inner shell. The outer shell may have a first alignment feature on a first side to mate with the first alignment feature on the inner shell and a second alignment feature on a second side to mate with the second alignment feature on the inner shell. The outer shell may be slid over the inner shell until the first alignment feature on a first side mates with the first alignment feature on the inner shell and a second alignment feature on a second side mates with the second alignment feature on the inner shell. When the first alignment feature on a first side mates with the first alignment feature on the inner shell and a second alignment feature on a second side mates with the second alignment feature on the inner shell, the outer shell may be mechanically and electrically attached to the inner shell, and the outer shell may be physically aligned with the inner shell.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
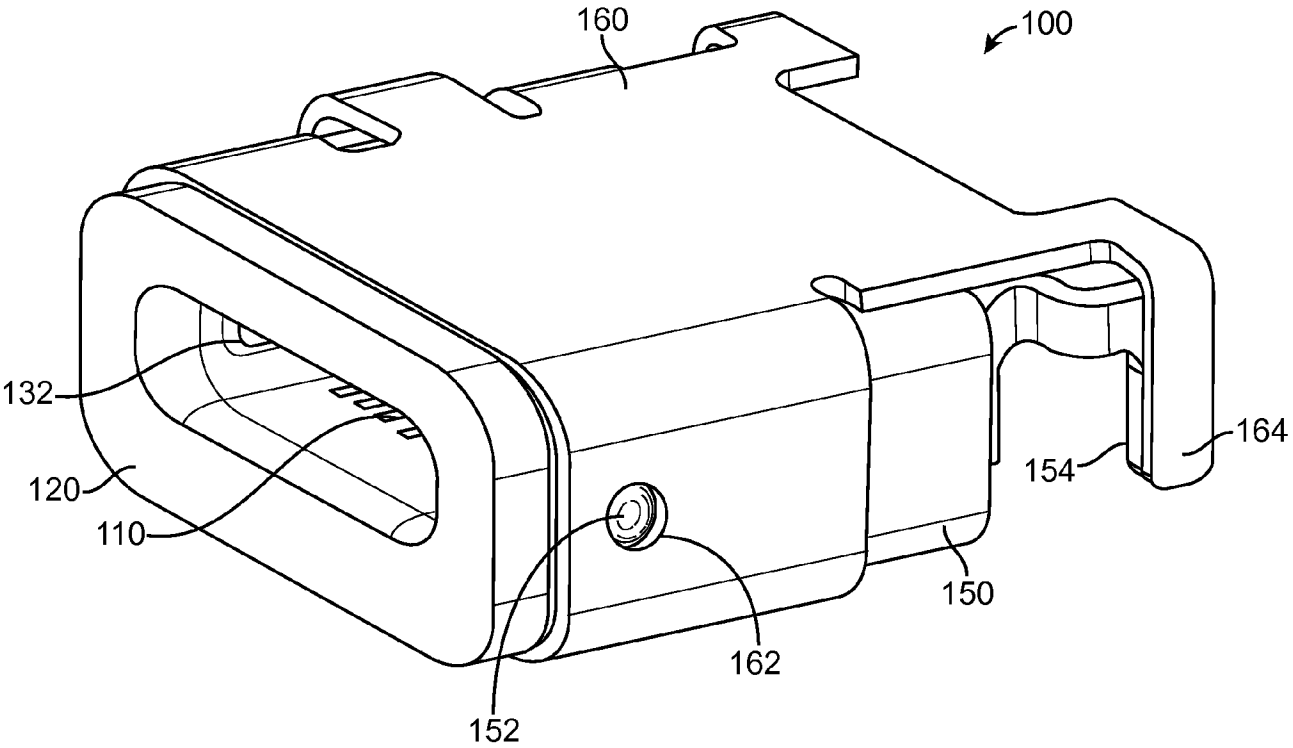
FIG. 1 illustrates a connector receptacle according to an embodiment of the present invention.

FIG. 1 illustrates a connector receptacle according to an embodiment of the present invention. This figure, as with the other included figures, is shown for illustrative purposes and does not limit either the possible embodiments of the present invention or the claims.

Connector receptacle 100 may include housing 120. Housing 120 may support contacts 110 and 132. Contacts 110 may be signal, power, or ground contacts. Contacts 132 may be ground or other types of contacts. Side contacts 132 may also provide retention features for a connector insert (not shown.)

A shield for connector receptacle 100 may include two shells. Specifically, a shield may be formed of inner shell 150 and outer shell 160. Inner shell 150 may include one or more alignment features, such as protrusion 152. Outer shell 160 may also include one or more alignment features, such as opening or hole 162. Inner shell 150 may include tabs 154 and outer shell 160 may include tabs 164. Tabs 154 and 164 may be soldered or otherwise fixed to a printed circuit board, flexible circuit board, device enclosure, or other board or appropriate substrate.

In embodiments of the present invention, when one or more alignment features on an inner shell mate with one or more alignment features on an outer shell, the outer shell may be held in place relative to the inner shell by this mating. This, in turn, may allow the formation of a shield for a connector receptacle without relying on soldering or spot or laser welding to join two or more shells together.

The various components of connector receptacle 100 may be formed using various materials. For example, housing 120 may be formed of plastic, nylon, or other non-conductive material. Contacts 110 and 130, inner shell 150, outer shell 160, and other conductive portions may be formed using a conductive material, such as metal. They may be formed using stainless steel, copper, copper alloy, tin, brass, palladium nickel, or other material. These conductive portions may be plated with gold, tin, or other material; for example, to increase durability, conductivity, or solderability.

In various embodiments of the present invention, connector receptacle 100 may be compatible with various signal interfaces, such as Universal Serial Bus (USB), High-Definition Multimedia Interface (HDMI), Digital Visual Interface (DVI), DisplayPort, Thunderbolt, or other types of interfaces. Connector receptacle 100 and its corresponding connector insert (not shown) may be connector inserts and connector receptacles such as those shown in co-pending U.S. patent application Ser. Nos. 13/607,366 and 13/607,439, both filed Sep. 7, 2012, which are incorporated by reference.

While embodiments of the present invention are well-suited to connector receptacles, other structures, such as connector inserts or device enclosures, may be improved by the incorporation of embodiments of the present invention.

Figure 2:
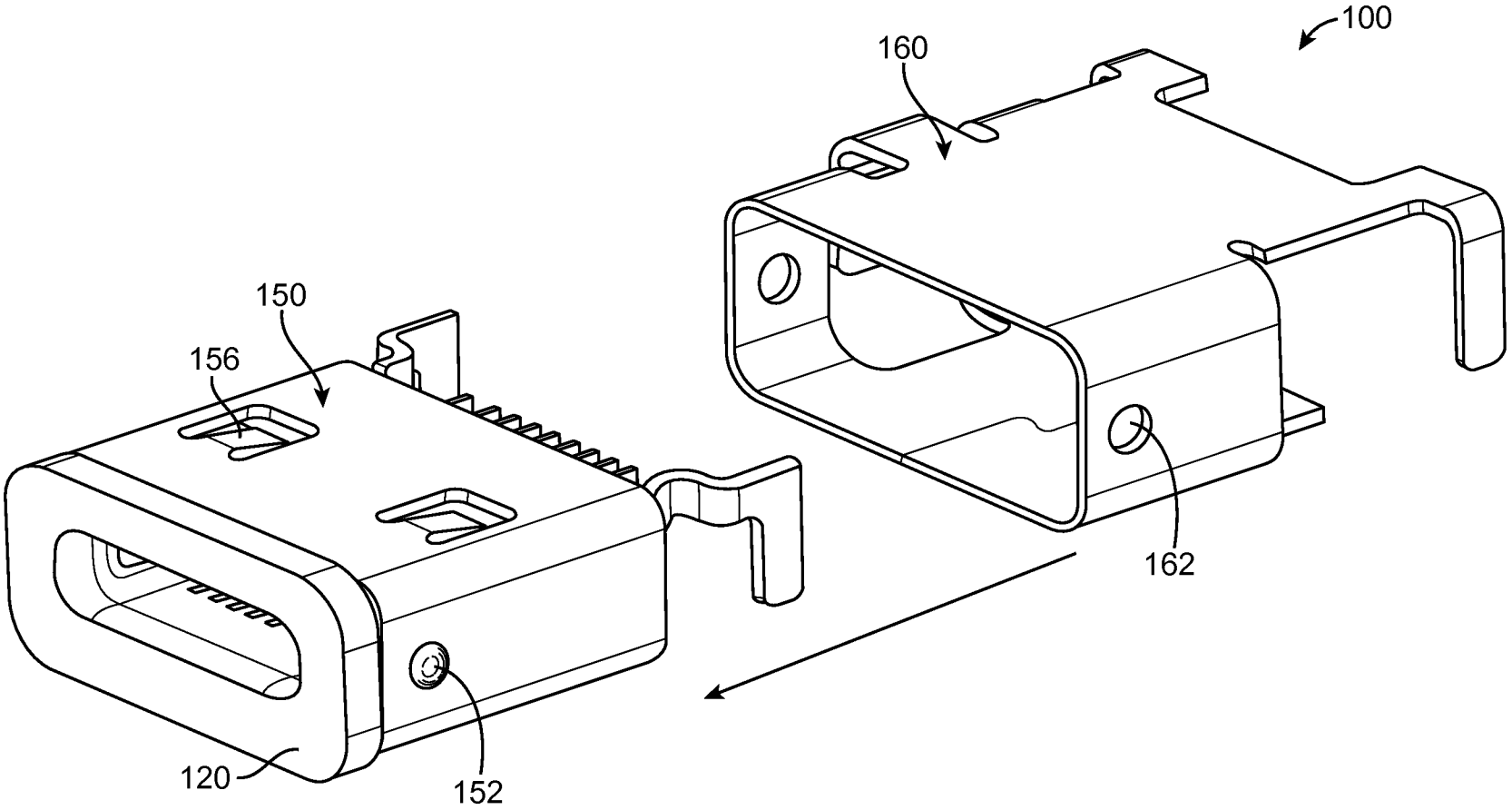
FIG. 2 illustrates a portion of an assembly procedure for a connector receptacle according to an embodiment of the present invention.

FIG. 2 illustrates a portion of an assembly procedure for a connector receptacle according to an embodiment of the present invention. An opening and a front of inner shell 150 may be aligned with a rear side of housing 120. Inner shell 150 may be slid over housing 120. Downwardly-biased fingers 156 may snap into a cutout (not shown) on a top of housing 120. The placement of fingers 156 in the cutout in housing 120 may secure inner shell 150 to housing 120.

A front side opening of outer shell 160 may be aligned with a rear of inner shell 150 and housing 120. Outer shell 160 may be slid onto inner shell 150. Alignment feature 162 on outer shell 160 may mate with alignment feature 152 on inner shell 150. This mating may hold outer shell 160 in place relative to inner shell 150. In this embodiment of the present invention, alignment feature 152 may be a raised, dimpled, or other shaped protrusion. This raised dimple or protrusion may be formed by stamping into inner shell 150. Alignment feature 162 may be an opening or hole in other shell 160.

Again alignment features 152 and 162 may mechanically fix inner shell 150 and outer shell 160 together without the need for soldering, or sport or laser welding. These features may also align outer shell 160 to inner shell 150. They may also provide an electrical connection between outer shell 160 and inner shell 150.

Figure 3:
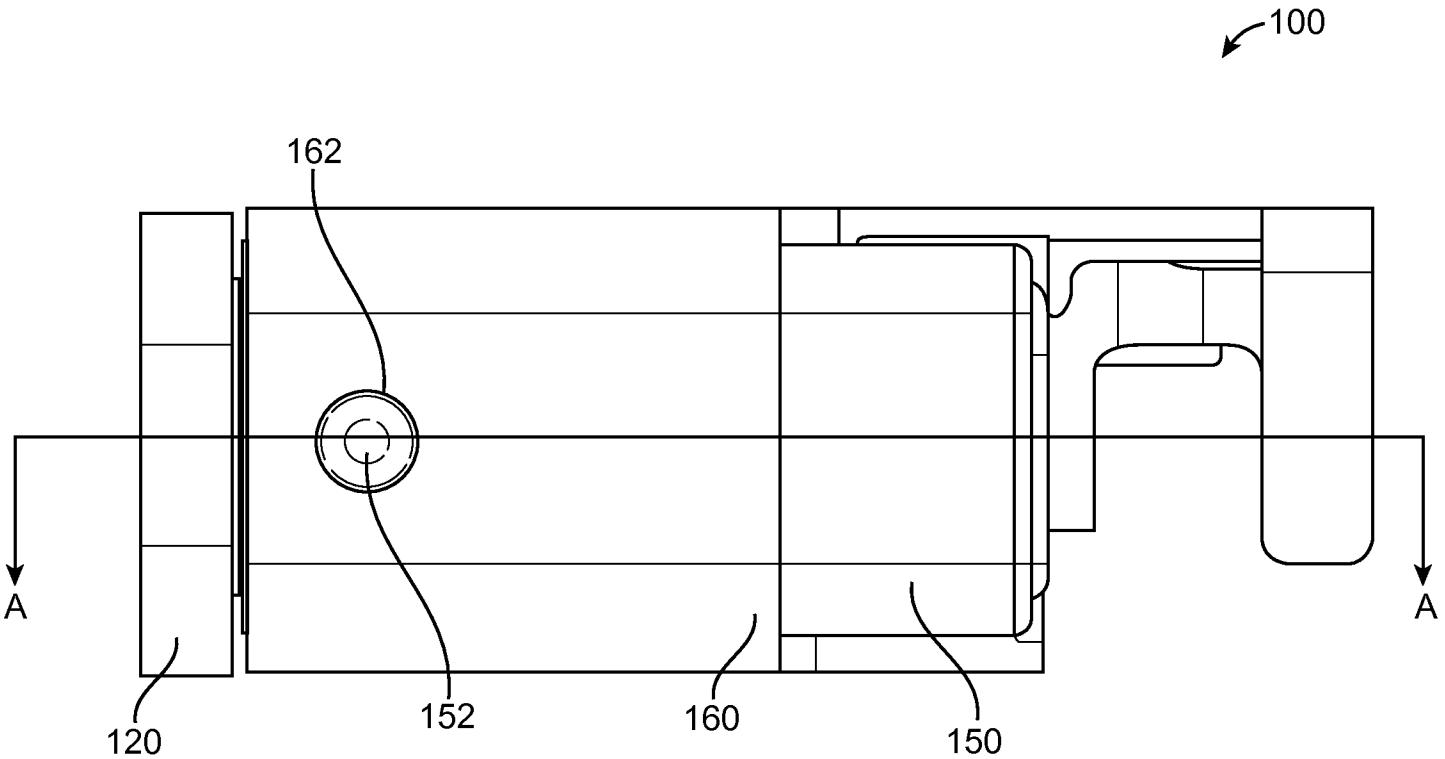
FIG. 3 illustrates a side view of a connector receptacle according to an embodiment of the present invention.

FIG. 3 illustrates a side view of a connector receptacle according to an embodiment of the present invention. Connector receptacle 100 may include housing 120, inner shell 150, and outer shell 160. Alignment feature 152 on inner shell 150 may be aligned with alignment feature 162 on outer shell 160. When alignment feature 152 on inner shell 150 mates with alignment feature 162 on shell 160, outer shell 160 may be held in place relative to inner shell 150.

Figure 4:
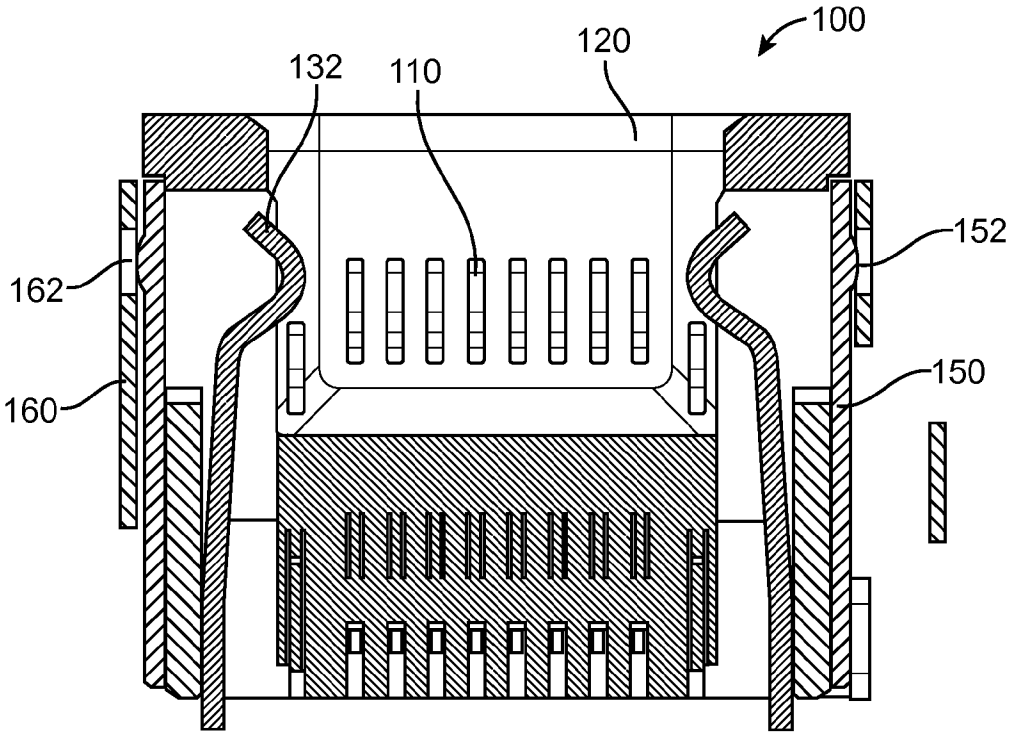
FIG. 4 illustrates a cutaway view of a connector receptacle according to an embodiment of the present invention.

FIG. 4 illustrates a cutaway view of a connector receptacle according to an embodiment of the present invention. Specifically, this figure illustrates a cutaway view of connector receptacle 100 along line A-A as shown in FIG. 3. Connector receptacle 100 may include housing 120, which may support contacts 110 and 132. Inner shell 150 may include alignment features 152. Outer shell 160 may include alignment features 162.

In this embodiment of the present invention, alignment feature 152 on inner shell 150 is again shown as a raised dimple. In other embodiments of the present invention, this feature may be other raised or protruding area, it may be a hole or opening, or it may be a depressed area or other alignment feature. Also in this embodiment of the present invention, alignment feature 162 on outer shell 160 is again shown as a hole or opening. In other embodiments of the present invention, this feature may be a raised or protruding area, a depressed area, or other alignment feature.

Figure 5:
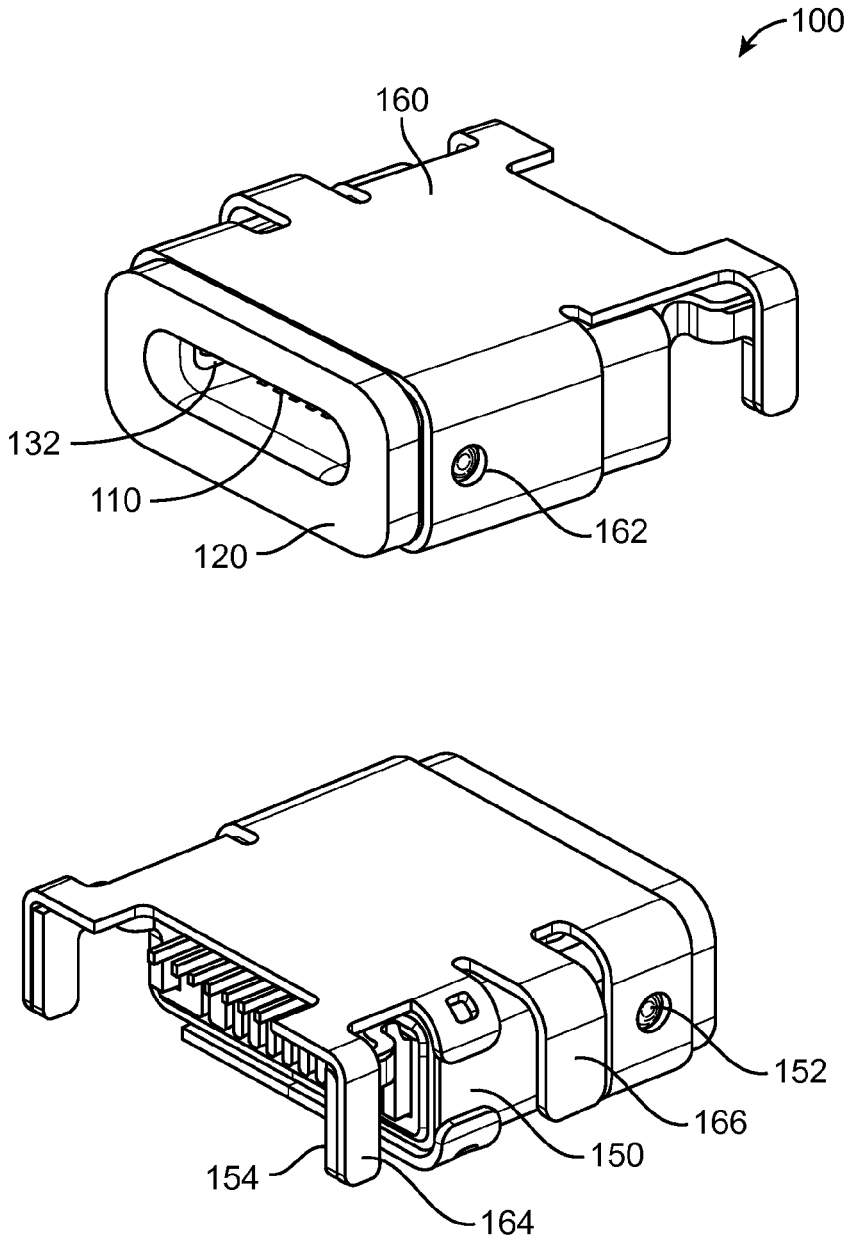
FIG. 5 illustrates front and back oblique views of a connector receptacle according to an embodiment of the present invention.

FIG. 5 illustrates front and back oblique views of a connector receptacle according to an embodiment of the present invention. Connector receptacle 100 may include housing 120 having a front opening for accepting a connector insert (not shown.) Connector receptacle 100 may include side ground contacts 132 and signal or bottom contacts 110. Connector receptacle 100 may further include a shield formed of inner shell 150 and outer shell 150. Tabs 154 and 164 may be used to fix connector receptacle 100 to a main logic board, flexible circuit board, device enclosure, or other structure.

Again, in this example, inner shell 150 and outer shell 160 may each include one or more alignment features. These alignment features may be holes or openings, depressions (for example, a depression formed by a large dimple), raised portions, dimples, slots, cantilever or other types of beams, fingers, or other alignment features. For example, in one embodiment of the present invention, two parallel slots may be formed in one shell, with a middle portion between the slots pushed out. This may fit in a slot or other opening or depression in the other shell. These various alignment features may be stamped or cut into shells 150 and 160 either before or after they have been folded and bent into shape.

Figure 6:
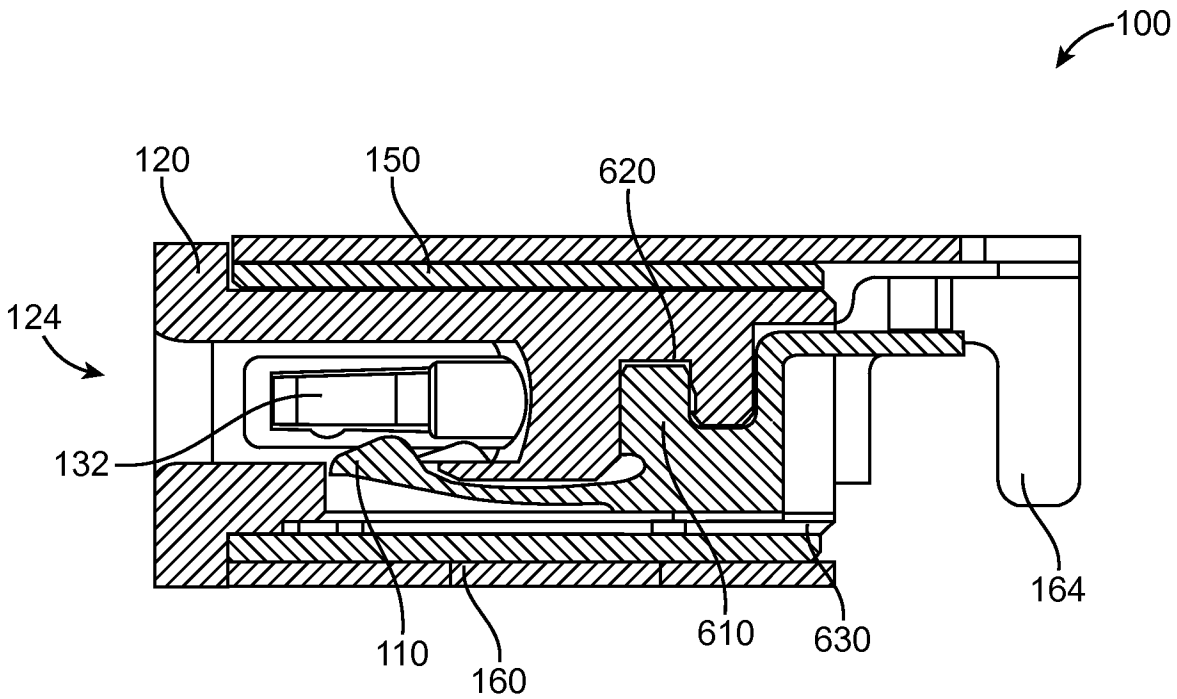
FIG. 6 illustrates a side view of a connector receptacle according to an embodiment of the present invention.

FIG. 6 illustrates a side view of a connector receptacle according to an embodiment of the present invention. Again, connector receptacle 100 may include housing 120 around contacts 110 and 132. A shield may be placed at least partially around housing 120. This shield may include inner shell 150 and outer shell 160. The shield may cover a bottom side opening to protect contacts 110. The shield may be insulated from contacts 100 by insulative layer 630. Tabs 164 may extend from outer shell 160.

In this example, contacts 110 may be inserted through a bottom opening in housing 120. Specifically, stabilizing piece 610 of contact 110 may be inserted into grove 620. A latch including side ground contacts 132 may be inserted into housing 120. Tape or insulation 630 may be applied. Inner shell 150 and outer shell 160 may be fixed around housing 120.

Figure 7:
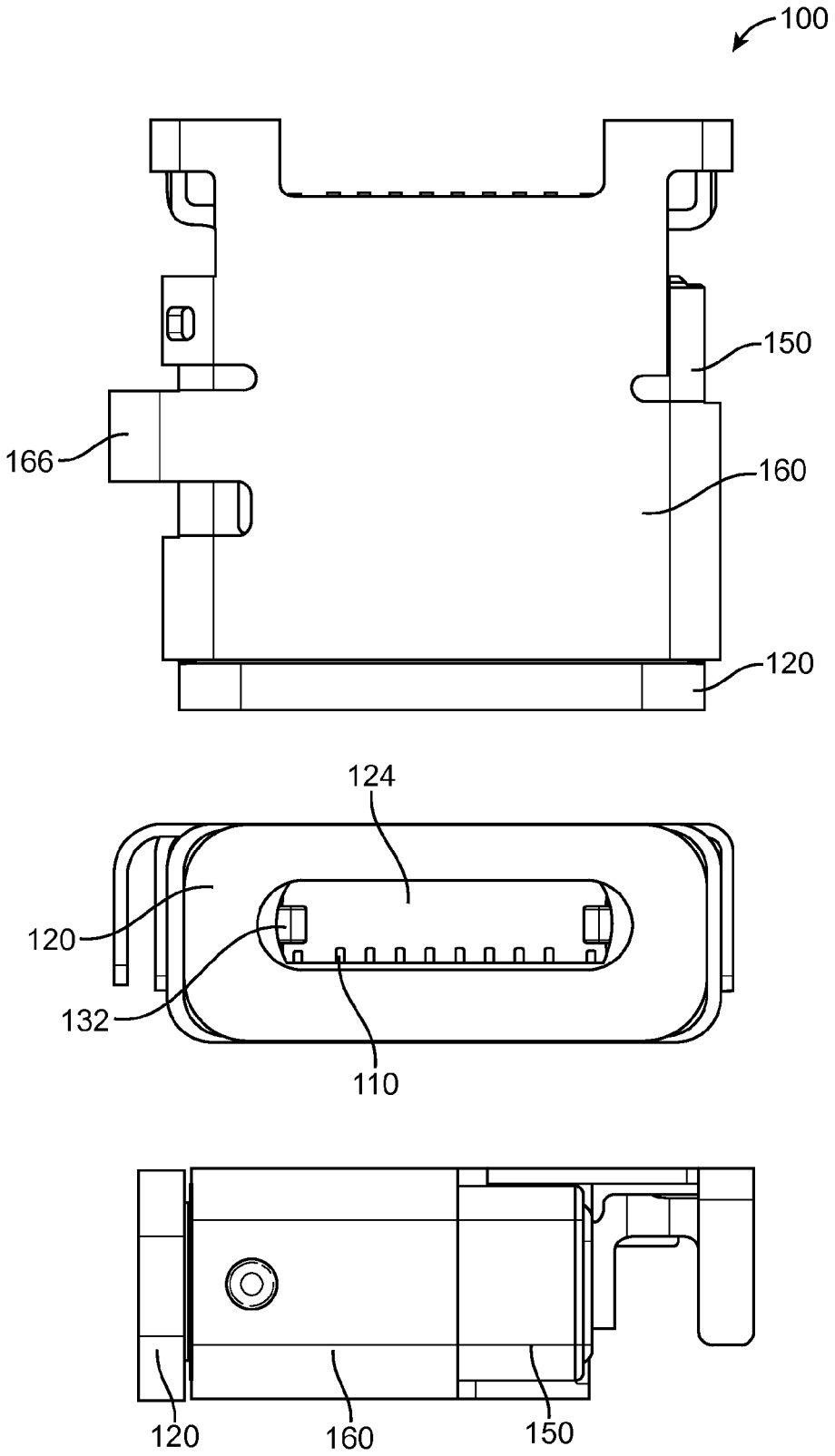
FIG. 7 illustrates top, front, and side views of a connector receptacle according to an embodiment of the present invention.

FIG. 7 illustrates top, front, and side views of a connector receptacle according to an embodiment of the present invention. Again, connector receptacle 100 may include a front side opening 124 in housing 120, which may provide access to side ground contacts 132 and bottom contacts 110. Housing 120 may be at least partially encased by a shield formed by inner shell 150 and outer shell 160. Tab 166 may extend from outer shell 160.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a housing having an opening to receive a connector insert;

a plurality of contacts located in the opening;

an inner shell at least partially surrounding the housing, the inner shell having a first alignment feature on a first side and a second alignment feature on a second side; and an outer shell at least partially surrounding the inner shell, the outer shell having a first alignment feature on a first side to mate with the first alignment feature on the inner shell and a second alignment feature on a second side to mate with the second alignment feature on the inner shell, wherein when the first alignment feature on a first side mates with the first alignment feature on the inner shell and a second alignment feature on a second side mates with the second alignment feature on the inner shell, the outer shell is mechanically attached to the inner shell.

2. The connector receptacle of claim 1 wherein the first alignment feature on the inner shell is a protrusion.

3. The connector receptacle of claim 1 wherein the first alignment feature on the inner shell is a dimple.

4. The connector receptacle of claim 1 wherein the first alignment feature on the outer shell is a hole.

5. The connector receptacle of claim 1 wherein the plurality of contacts are located in a bottom of the opening.

6. The connector receptacle of claim 1 wherein the inner shell further includes a plurality of fingers biased inward such that they rest in openings in the housing to secure the inner shell to the housing.

7. The connector receptacle of claim 1 wherein the inner shell and the outer shell are formed of a metal selected from the group consisting of copper alloy and stainless steel.

8. A method of assembling a connector receptacle, the method comprising:

receiving a housing, the housing having a front side opening to receive a connector insert;

aligning a front opening of an inner shell to a back of the housing, the inner shell having a first alignment feature on a first side and a second alignment feature on a second side;

sliding the inner shell to fit over the housing;

aligning a front opening of an outer shell to a back of the housing and the inner shell, the outer shell having a first alignment feature on a first side to mate with the first alignment feature on the inner shell and a second alignment feature on a second side to mate with the second alignment feature on the inner shell; and sliding the outer shell over the inner shell until the first alignment feature on a first side mates with the first alignment feature on the inner shell, and a second alignment feature on a second side mates with the second alignment feature on the inner shell such that the outer shell is mechanically attached to the inner shell.

9. The method of claim 8 wherein the housing is formed of a non-conductive material.

10. The method of claim 9 wherein the inner shell and the outer shell are formed of a metal selected from the group consisting of copper alloy and stainless steel.

11. The method of claim 8 wherein the first alignment feature on the inner shell is a protrusion and the first alignment feature on the outer shell is a hole.

12. The method of claim 8 further comprising:

forming the first alignment feature in the inner shell by stamping a protrusion into the inner shell.

13. The method of claim 12 further comprising:

forming the first alignment feature in the outer shell by stamping an opening in the outer shell.

14. The method of claim 8 wherein the inner shell further includes a plurality of fingers biased inward such after the inner shell is slid over the housing, the fingers rest in openings in the housing to secure the inner shell to the housing.

15. A shield for a connector receptacle, the shield comprising:

an inner shell having a first alignment feature on a first side and a second alignment feature on a second side; and an outer shell at least partially surrounding the inner shell, the outer shell having a first alignment feature on a first side to mate with the first alignment feature on the inner shell and a second alignment feature on a second side to mate with the second alignment feature on the inner shell, wherein when the first alignment feature on a first side mates with the first alignment feature on the inner shell and a second alignment feature on a second side mates with the second alignment feature on the inner shell, the outer shell is mechanically attached to the inner shell.

16. The shield of claim 15 wherein the inner shell and the outer shell are formed of a metal selected from the group consisting of copper alloy and stainless steel.

17. The shield of claim 16 wherein the inner shell and the outer shell are plated with tin.

18. The shield of claim 15 wherein the first alignment feature on the inner shell is a protrusion.

19. The shield of claim 15 wherein the first alignment feature on the inner shell is a dimple.

20. The shield of claim 15 wherein the first alignment feature on the outer shell is a hole.

* * * * *